US008424643B1

(12) United States Patent
Speaks

(10) Patent No.: US 8,424,643 B1
(45) Date of Patent: Apr. 23, 2013

(54) BOAT WORK PLATFORM

(76) Inventor: Joaquin Speaks, New Britain, CT (US)

( * ) Notice: Subject to any disclaimer, the term of this patent is extended or adjusted under 35 U.S.C. 154(b) by 86 days.

(21) Appl. No.: 13/105,053

(22) Filed: May 11, 2011

Related U.S. Application Data

(60) Provisional application No. 61/334,210, filed on May 13, 2010.

(51) Int. Cl.
*E06C 1/00* (2006.01)

(52) U.S. Cl.
USPC ..... 182/180.3; 182/91

(58) Field of Classification Search .... 182/180.1–180.3, 182/152, 156, 115, 91; 114/362
See application file for complete search history.

(56) References Cited

U.S. PATENT DOCUMENTS

| | | | | |
|---|---|---|---|---|
| 795,451 | A * | 7/1905 | Rice | 182/61 |
| 826,582 | A * | 7/1906 | Laird | 182/124 |
| 1,351,053 | A * | 8/1920 | Macklem | 182/119 |
| 6,053,284 | A * | 4/2000 | Fountain | 182/180.2 |

* cited by examiner

*Primary Examiner* — James O Hansen
*Assistant Examiner* — Kristine Florio
(74) *Attorney, Agent, or Firm* — UConn IP Law Clinic; Susan K. Pocchiari; Emily Reese

(57) ABSTRACT

A portable support system for a work platform is provided which is particularly adapted for use on and around boats in order to provide safe access to the superstructure of the boat.

1 Claim, 3 Drawing Sheets

BOAT WORK PLATFORM

CROSS REFERENCE

This application is a non-provisional application of provisional application 61/334,210 filed May 13, 2010, which is incorporated herein by reference in its entirety.

FIELD OF THE INVENTION

The invention relates to the field of support systems for aiding in cleaning and maintenance of vehicles. The invention particularly relates to the support systems for boating needs.

BACKGROUND OF THE INVENTION

There are great needs for a portable platform support system designed to provide a stable and safe working platform with variable working heights, especially for working on boats. During the repair or cleanup of a boat superstructure, and particularly during body work such as waxing, it often arises that workers need easy, safe access to the upper part of the boat structure. By way of example, when cleaning a superstructure of a boat, it is often very difficult to clean the top portion of the structure owing to the fact that no convenient platform or other means is available to give the worker proper access. This difficulty can be particularly pronounced in the case of taller boats. In attempting to work on hard-to-reach areas, such as the upper area of the superstructure, workers may cause damage to other portions of the boat or may cause injury to themselves.

Currently, working on the surface of the superstructure of a boat has been done with stepladders and scaffolds. Conventional ladders are of limited utility in boat environments because step ladder rungs will normally be oriented perpendicular to the boat superstructure surface, leading workers to turn their bodies to work on the boat structure while standing on the ladder platform. This will put workers in a very unnatural and unsafe position. Workers can certainly consider employing scaffolding on the deck. However, this method is expensive and is not ideal on a narrow path like the boat deck between the super structure and the boat railing. Due to this narrow deck area between the superstructure and boat railing, some workers resort to suspending themselves from the top of the structure using a rope. These customary methods of working on the high superstructure of boats have been found to be inefficient and unsafe.

There is accordingly a decided need in the art for an improved portable work platform support system especially adapted for use on and around the boat superstructure, which permits easy, safe, and convenient access to all areas of the superstructure while providing a stable work platform.

BRIEF SUMMARY OF THE INVENTION

The present invention overcomes the challenges described above and provides a portable work platform support system particularly suited for facilitating access to and around a boat superstructure. The portable work platform support system broadly includes a generally horizontal platform; a generally horizontal base member; a first substantially vertical leg extending between the first end of the platform and the first end of the base member and being hingedly attached to the base member; a second leg extending from the first end of the platform to the second end of the base member, and which is hinged at the platform attachment point and detachable from the base member, enabling it to be folded towards the first leg;

and an extendable support member adapted to be connected between the second end of the platform and the railing of a boat. The base member may optionally have ground engaging support means perpendicularly attached to each end. The first leg may have a plurality of steps to permit easy access by a worker. The support system is adjustable to fit in a deck area between a boat superstructure and a boat railing to provide a secure and safe work platform to the workers performing various tasks on the boat superstructure.

As will be readily appreciated by one of ordinary skill in the art, a worker may employ two or more of the work platform support systems of the invention in close proximity to each other with a plank or similar walkway supported between the generally horizontal platforms thereof to provide a secure working environment. If two support systems were used, they would conveniently be chosen so that the left hand one had steps on the left side of the first leg and the right hand one had steps on the right side of the first leg, respectively.

In one embodiment, the legs and the base member are adjustable in length by a telescoping mechanism. The base member adjustability will permit the portable work platform support system to fit snugly on a boat deck between the railing and the boat structure while the adjustability of the legs will enable the working platform to be raised or lowered to allow workers to reach any portion of the boat superstructure. In a similar fashion, the length of the boat-railing-engaging support member may be adjusted in order to be attached to the boat railing to provide increased structural stability once the ideal height of the portable work platform support system is determined.

To conveniently store this embodiment of the invention, the ladder steps are pivoted into a vertical position and the base member and both legs are reduced to convenient storage lengths. The base member is detached from the ground engaging support means that is attached to the second leg and swung into an upright position. Finally, the second leg is pivoted into a substantially vertical position adjacent to the first leg, whereby the entire assembly assumes a compact, folded-up storage position.

The portable work platform support system may be composed of any material having sufficient strength and rigidity to support a user. Metals and metal alloys, such as aluminum, or other materials such as carbon fiber or graphite fiber composites may conveniently be used.

DETAILED DESCRIPTION OF THE DRAWINGS

Figure 1:
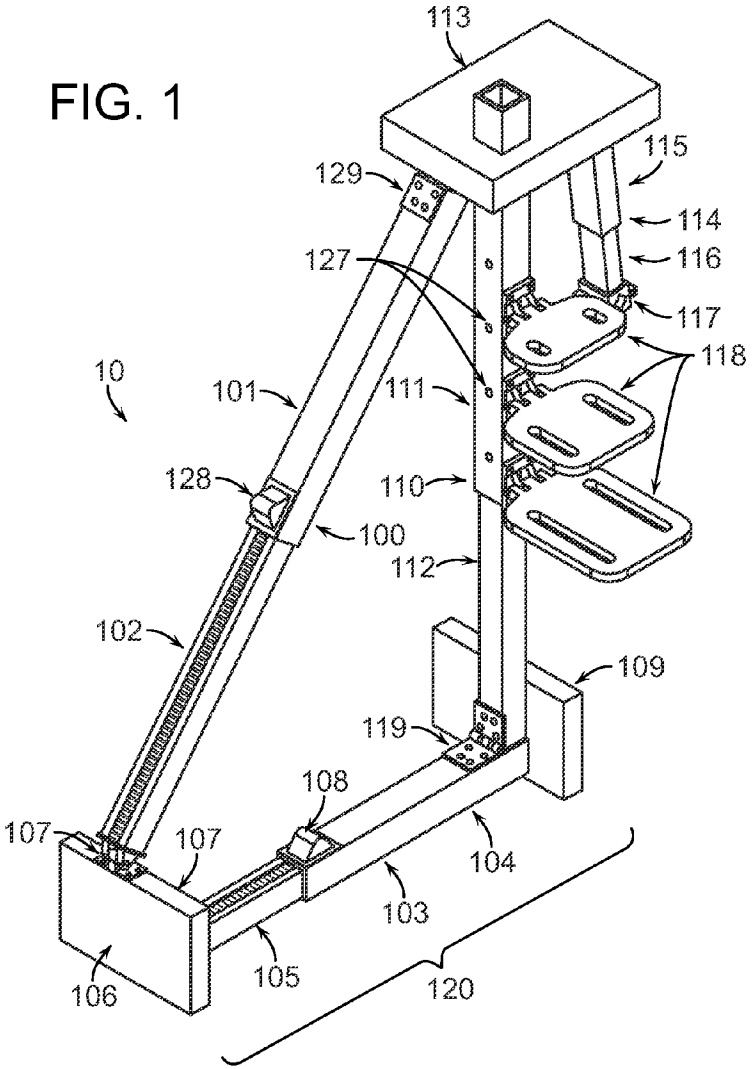
FIG. 1 is a perspective view of a work platform support system in accordance with the invention, illustrated in its upright use position.

Turning now to the drawings, and particularly FIG. 1, a portable work platform support system 10 is depicted. Broadly speaking, the portable work platform support system 10 includes a substantially horizontal platform 113, a ground engaging base system 120 having ground engaging support means 106 and 109; a first substantially vertical leg 110 attached to the first end of the platform 113 and the first end of the base member 103; a second leg 100 attached to the platform 113 proximate to the first leg 110 and the top of the ground engaging support means 106 attached to the second end of the base member 103; and a substantially vertically oriented boat railing engaging support member 114 attached to and projecting downward from the second end of the platform 113.

In more detail, the base member system 120 has a base member 103 comprised of a pair of elongated nested rectangular tubes, inner tube 105 and outer tube 104, such that the inner tube 105 is slideably adjustable in and out of the outer tube 104 to vary the length of the base member. The ground engaging support means 106 and 109 are attached at the either end of the base member 103. The outer tube 104 end of the base member 103 is pivotally attached to the first substantially vertical leg 110 forming an L-shape using a hinge 119. The ground engaging support means 109 is attached to the base member 103 and abuts the substantially vertical leg 110. The second ground engaging support means 106 is removeably attached to the inner tube 105 end of the base member 103. The second leg 100 is hingedly attached at the top surface of the ground engaging support means 106 using a pivoting system 107 comprised, for example, of an eye bracket and a clevis bracket held together by a steel pin. The second leg 100 is attached to the platform 113 proximate to the first leg 110 using a hinge 129 similar to the one used to connect the base member 103 and the first substantially vertical leg 110. Since the typical distance between a boat railing and a boat superstructure is between about 2 feet and about 4 feet, the length of the base member 103 should be able to be adjusted to between about 2 feet and about 4 feet. In order to provide the latitudinal support for the work platform support system 10 on a narrow working area, the horizontal dimension of the ground engaging support means 106, 109 should be large enough to provide stability but not so large as to prevent easy storage when the work platform support system is not in use, conveniently between about 1 foot and about 1.5 feet.

Figure 4:
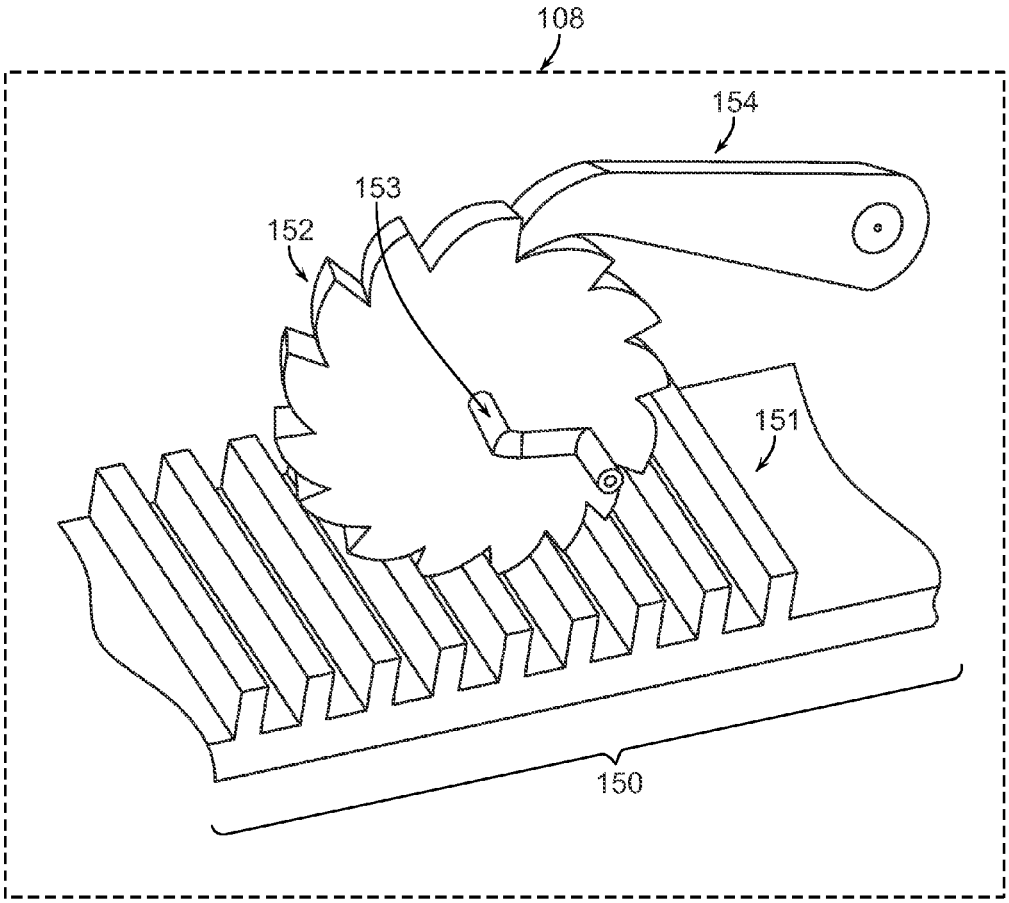
FIG. 4 is a perspective view of a gear rack system inside a housing unit used to adjust the length of the legs.

Similarly to the base member 103, the first substantially vertical leg 110 and the second leg 100 are also each comprised of a pair of nested elongated rectangular tubes—inner tube 112 and outer tube 111 for the first leg and inner tube 102 and outer tube 101 for the second leg, whereby each inner tube 102, 112 is slideably adjustable into and out of the respective outer tube 101, 111 to vary the height of the legs depending on the height of the boat structure and the desired height of the platform 113. As more clearly seen in FIG. 2 (described below), the first leg 110 and the second leg 100 are preferably located in an offset position relative to each other so that in storage position the second leg 100 can be pivoted vertically adjacent to the first leg 110 in a side by side orientation. For varying their lengths, the base member 103 and the second leg utilize a gear rack system 150 (described below with reference to FIG. 4) covered under a housing unit 108, 128 allowing the workers to manually adjust the lengths of the base member 103 and second leg 100. As shown in FIG. 4, each gear rack system is made up of a gear rack 151 and a head gear 152 having a head gear shaft 153 and engaging a ratchet pawl 154 positioned above the gear rack system 150, whereby a worker may attach a crank to the head gear shaft 153, release the ratchet pawl 154 lock, and vary the length of the leg.

The length of the first leg 110 is stabilized by inserting a safety pin (not shown) through one of the safety pin holes 127. The safety pin holes 127 in the side of outer tube 111 align with corresponding holes (not shown) in both sides of inner tube 112 and the opposite side of outer tube 111. The safety pin is inserted through one of holes 127 and through the corresponding holes in the inner tube 112 and the other side of outer tube 111 to prevent movement of tubes 111 and 112 with respect to each other when the work platform support system is in use.

The boat railing engaging support member 114, which is similar in structure to the base member 103 and the legs 100 and 110, is comprised of a pair of nested elongated rectangular tubes—inner tube 116 and outer tube 115—whereby the inner tube 116 is slideably adjustable in and out of the outer tube 115. The boat railing engaging support member 114 has a clamping mechanism 117 at the end of inner tube 116 for securely attaching to a boat railing. As the height of the portable work platform support system 10 is adjusted based on the boat structure, the boat railing engaging support member 114 may be adjusted depending on the placement of the platform 113 and the boat railing, so as to engage the boat railing as shown in FIG. 3.

Figure 3:
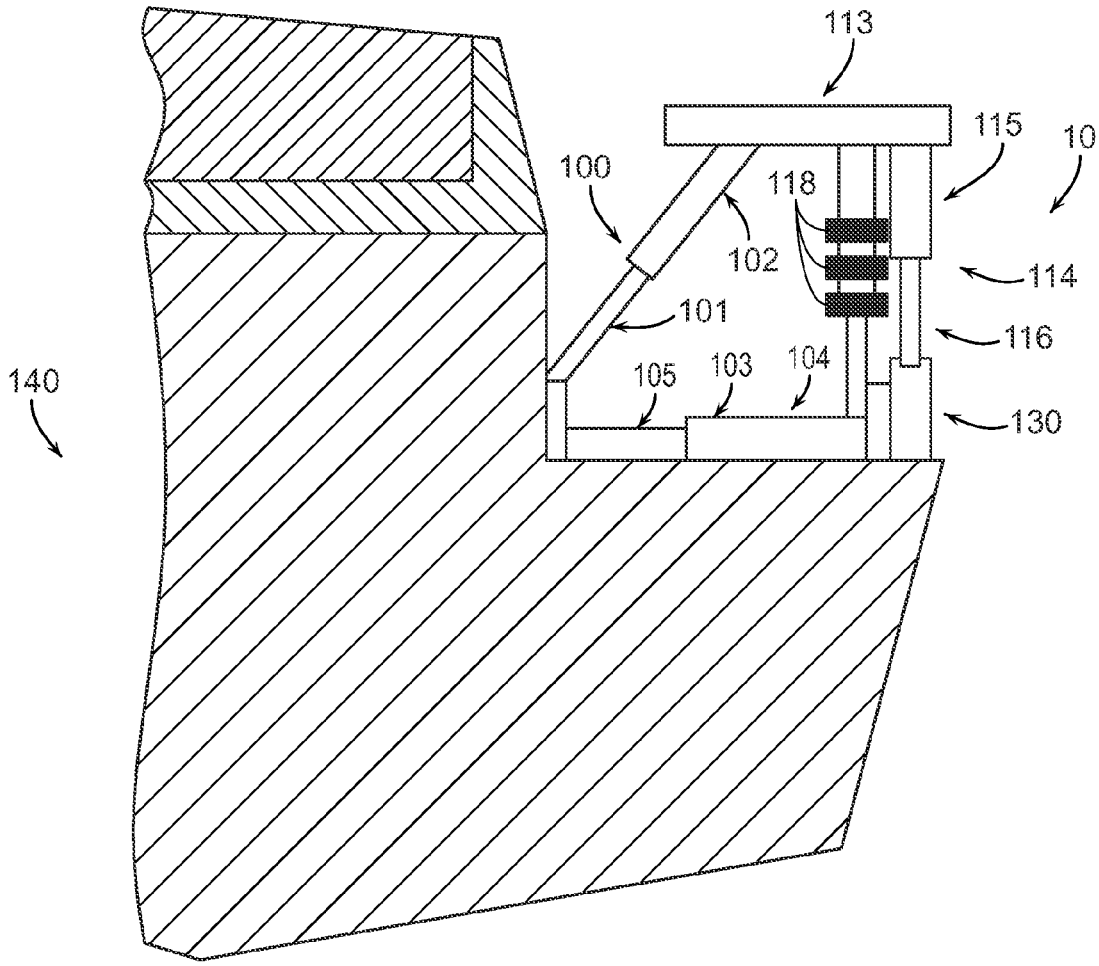
FIG. 3 is a side view of the working platform support system shown in operation on a boat.

With further reference to FIG. 3, when in use, the base member 103, the two legs 100, 110 and the railing-engaging support member 114 are all adjusted to fit in the boat structure and to provide the most secure and safe position for the boat workers. First, the base member 103 is extended or reduced in length to fit the distance between the boat railing 130 and the boat superstructure 140 thus causing the ground engaging support means 106, 109 to lie alongside the edge of the boat railing 130 and the wall of the boat superstructure 140, respectively. Second, both legs 100, 110 are extended or reduced in height to the optimal position to work on the boat structure. Third, once the heights of the legs are fixed, the length of the boat railing engaging support member 114 is adjusted to be connected to the top of the boat railing 130.

After use, the portable work platform support system 10 can be reduced to a more compact configuration for easy transport and storage. First, the second ground engaging support means 106 is detached from the inner tube 105 of the base member 103. Second, both legs 100, 110 and the base member 103 are slideably reduced in length to yield convenient storage lengths of each leg 100, 110 and the base member 103. Third, the base member 103 is pivotally rotated upward toward the first leg 110. Fourth, the second leg 100 is pivotally rotated to the substantially vertical position adjacent to the first leg 110 to yield the configuration shown in FIG. 2.

Figure 2:
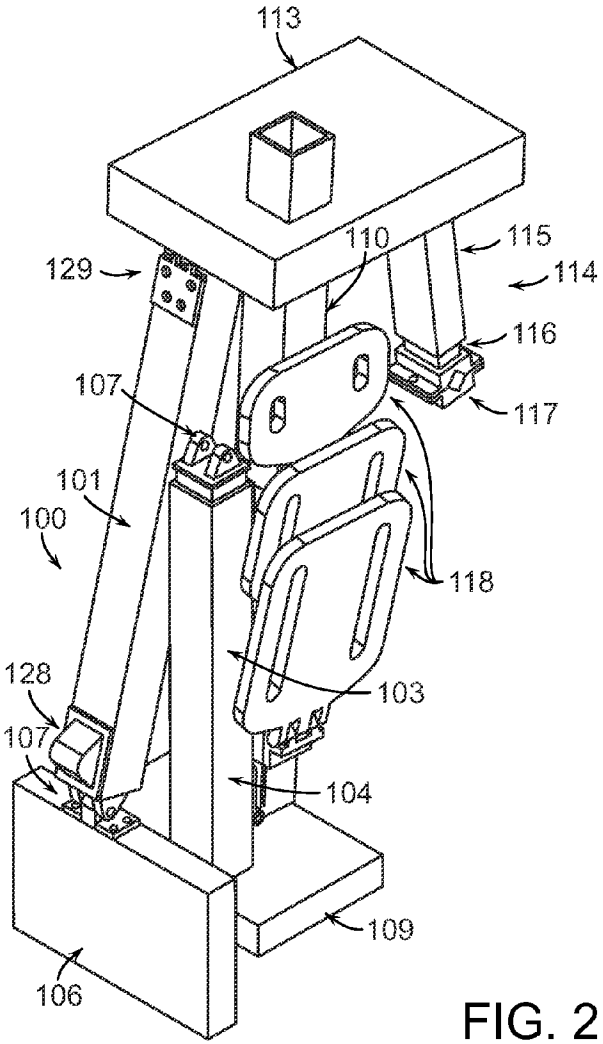
FIG. 2 is a perspective view of the work platform support system in its compact, folded-up storage position.

Ladder means include a plurality of laterally spaced apart steps 118 pivotally connected to the first leg 110 by means of cooperating pairs of metallic brackets and rods. When the portable work platform support system 10 is in use, the steps 118 will be locked in a substantially horizontal position able to support the weight of the worker as shown in FIG. 1. As best seen in FIG. 2, the steps may be pivoted vertically on the first leg 110 so that in the storage mode of the portable work platform support system 10, the entire assembly assumes a compact, folded-up storage position. Although the ladder means has been shown for illustration as being on the right side of the first substantially vertical leg, one of skill in the relevant art would readily understand that this placement is a matter of convenience and could be on the left hand side also.

While the invention has been described with respect to certain preferred embodiments thereof, those skilled in the art will recognize that many modifications and enhancements can be made thereto without departing from the true scope and spirit of the invention, which is limited only by the claims appended hereto.

I claim:

1. A portable work platform support system for use on a boat having deck and a railing, comprising:

a substantially horizontal platform having a top surface and a bottom surface and a first end and a second end;

a substantially horizontal base member having a top surface and a bottom surface and a first end and a second end and comprising:

1) an elongated hollow outer tube of substantially uniform cross section throughout its length having proximal and distal ends and an inner surface defining a cavity;

2) an elongated hollow inner tube adapted to fit into said cavity having proximal and distal ends, the distal end being slideably received in said cavity through said proximal end of said outer tube;

a first ground engaging support means attached to the first end of said base member and being substantially perpendicular to said base member;

a second ground engaging support means removably attached to the second end of said base member and being substantially perpendicular to said base member, wherein said second ground engaging support means has a top surface and a bottom surface;

a first substantially vertical leg extending between said platform and the the first end of said base member and hingedly attached to said base member, wherein said first leg comprises a substantially vertically elongated hollow outer tube of substantially uniform cross section throughout its length having proximal and distal ends and having an inner surface defining a cavity of generally rectangular cross section, and a substantially vertical elongated hollow inner tube having proximal and distal ends, the distal end being slideably received in said cavity through said proximal end of said outer tube;

a ladder means on said first leg including a plurality of spaced apart, substantially parallel steps;

a second leg hingedly attached to the bottom surface of said substantially horizontal platform proximate to the first leg and hingedly attached to the top surface of the second ground engaging support means, wherein said second leg comprises an elongated hollow outer tube of substantially uniform cross section throughout its length having proximal and distal ends and having inner surfaces defining a cavity, and an elongated hollow inner tube having proximal and distal ends, the distal end being slideably received in said cavity through said proximal end of said outer tube; and a slideably extendable railing engaging support member extending from the second end of said substantially horizontal platform, said support being adapted to attach to the top of a boat railing.

* * * * *